US006041793A

United States Patent [19]

Miyasaki

[11] Patent Number: 6,041,793

[45] Date of Patent: Mar. 28, 2000

[54] METHOD AND APPARATUS FOR REDUCING OIL CARGO SLUDGE IN TANKERS

[76] Inventor: Mace T. Miyasaki, 6203 Blackburn La., Baltimore, Md. 21212

[21] Appl. No.: 09/042,577

[22] Filed: Mar. 17, 1998

Related U.S. Application Data

[60] Provisional application No. 60/041,395, Mar. 18, 1997.

[51] Int. Cl.[7] ..... B08B 9/00

[52] U.S. Cl. ..... 134/22.1; 134/22.18; 134/168 R; 134/169 R

[58] Field of Search ..... 134/22.1, 22.18, 134/22.17, 22.19, 168 R, 169 R, 166 R, 167 R

[56] References Cited

U.S. PATENT DOCUMENTS

| | | | |
|---|---|---|---|
| 4,364,776 | 12/1982 | McBride et al. | 134/10 |
| 4,426,233 | 1/1984 | Manabe et al. | 134/21 |
| 4,642,138 | 2/1987 | Koyase et al. | 134/22.18 |
| 4,828,625 | 5/1989 | Moran | 134/22.18 |
| 5,087,294 | 2/1992 | Rechtzigel | 134/22.1 |
| 5,091,016 | 2/1992 | Krajicek et al. | 134/22.1 |
| 5,269,234 | 12/1993 | Powell | 110/246 |
| 5,495,986 | 3/1996 | Davenport | 241/21 |
| 5,653,865 | 8/1997 | Miyasaki | 208/13 |

*Primary Examiner*—Randy Gulakowski
*Assistant Examiner*—Saud Chaudhry
*Attorney, Agent, or Firm*—Foley & Lardner

[57] ABSTRACT

A method and apparatus for converting crude oil tank bottoms in the cargo tanks of a ship to a liquid state is provided. The method comprises subjecting crude oil sludge contained in the tanker cargo tank to a collection system to facilitate extracting the sludge mixture from the bottom of the tank; comminuting the sludge mixture to reduce the size of sludge globules contained therein to produce a homogeneous mixture; optionally adding crude oil from the cargo tank to increase the homogeneity of the mixture; optionally adding an additional quantity of cutter stock and/or other selected additives to the sludge mixture, either before, during or after comminution, to form a blend stock.

20 Claims, 3 Drawing Sheets

METHOD AND APPARATUS FOR REDUCING OIL CARGO SLUDGE IN TANKERS

This application claims priority from U.S. Provisional Application No. 60/041,395, filed Mar. 18, 1997.

BACKGROUND OF THE INVENTION

1. Field of the Invention

The present invention relates to reducing the accumulation of sludge in tanker ships and in particular to recovering the fuel value from crude oil tanker bottoms.

2. Description of Related Art

A particular problem arises when transporting crude oil and petroleum products in tanker ships in which sludge accumulates on the bottom of the cargo tanks and often accumulates to significant depths. Heavy crude oil often can contain as much as 3 to 5% of the crude oil volume in globular form. When this crude oil is put into the cargo tanks of a tanker ship, the globular oil settles to the bottom of the tank. As successive loads of crude oil are transitioned through the tank, a thick layer of the settled globular oil accumulates in the bottom of the tank as a heavy sludge.

The accumulated tank bottoms decreases the usable volume of the tank and decreases the volume of delivered oil to the destination, resulting in an economic loss of cargo volume during transit from the loading port to the destination port.

A normal method of disposing of the tank bottoms is to flush the cargo tank with sea water, often under high pressure, and to discharge the resultant mixture overboard after the ship is in open ocean waters. This is an economic loss, for that volume of tank bottoms discharged is lost crude oil volume.

Periodically the ship is withdrawn from service and put into a shipyard for maintenance. At this time it is customary to remove remaining sludge in the cargo tanks to inspect and repair, if necessary, the walls of the tanks. The tank bottoms removed in this operation is usually incinerated or otherwise disposed of at a cost, with the complete loss of the economic value of the crude oil.

There is presently no effective method in use to process the crude oil tank bottoms in the tanker so that the economic value of the crude oil sludge is retained for discharge at the destination terminal.

SUMMARY OF THE INVENTION

One object of the invention is to obtain substantial recovery of the value of the crude oil tank bottoms in cargo tanks.

Another object of the invention is to provide a system design that can be installed in the tanker ship that can process the sludge to produce a pumpable crude oil stock.

These and other objectives are achieved by providing: a method for converting crude oil tank bottoms to a liquid state comprising subjecting crude oil sludge contained in the tanker cargo tank to a collection system to facilitate extracting the sludge mixture from the bottom of the tank, comminuting the sludge mixture to reduce the size of sludge globules contained therein to produce a homogeneous mixture, optionally adding in crude oil from the cargo tank to increase the homogeneity of the mixture, optionally adding an additional quantity of cutter stock and/or other selected additives to the sludge mixture, either before, during or after comminution, to form a blend stock.

In further accordance with the present invention, there is provided a system for extracting crude oil sludge from the bottom of a cargo tank, the system comprising a number of auger pumps with open tops at points along the length of the tubing to collect and pump sludge, injectors through which crude oil or other liquid is pumped to loosen the sludge collected at the bottom of the storage tank, a system of pipes to collect the sludge and transport it to a section of the ship in which processors can be operated, and processors which contain a comminution chamber including therein a means to reduce the size of sludge globules contained within the sludge mixture, and an outlet for a blend stock product.

Additional objects, features and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and, together with the general description given above and the detailed description given below, serve to explain the principles of the invention.

DETAILED DESCRIPTION

The present invention provides a method for converting crude oil tank bottoms to a liquid state comprising subjecting crude oil sludge contained in the tanker cargo tank to a collection system to facilitate extracting the sludge mixture from the bottom of the tank, comminuting the sludge mixture to reduce the size of sludge globules contained therein to produce a homogeneous mixture, optionally adding in crude oil from the cargo tank to increase the homogeneity of the mixture, optionally adding an additional quantity of cutter stock and/or other selected additives to the sludge mixture, either before, during or after comminution, to form a blend stock.

In addition, circulatory equipment designed to further comminute and homogenize the contents of the cargo tank can be optionally added to the system. Advantageously, a liquid mixture having a product specification essentially identical to the crude oil in the cargo tank is produced, and substantially all the fuel value of the crude oil sludge is recovered while maintaining the standardized product specification of the crude oil.

In further accordance with the present invention, there is provided a system for extracting crude oil sludge from the bottom of a cargo tank, the system comprising a number of auger pumps with open tops at points along the length of the tubing to collect and pump sludge, injectors through which crude oil or other liquid is pumped to loosen the sludge collected at the bottom of the storage tank, a system of pipes to collect the sludge and transport it to a section of the ship in which processors can be operated, and processors which contain a comminution chamber including therein a means to reduce the size of sludge globules contained within the sludge mixture, and an outlet for a blend stock product.

Advantageously, the apparatus will further comprise at least one diluent injection port which is connected to, and in fluid communication with the comminution chamber, the injection port being adapted to controllably inject a variable quantity of diluent into the sludge mixture so as to improve the flowability of the blend stock product.

The invention further provides an optional system for circulating the oil and sludge in the cargo tank during the time the ship is in transit and shearing, mixing, and homogenizing the sludge with the crude oil using circulation units mounted in the cargo tanks that will create vertical circulation patterns in the tank, further mixing the sludge from the bottom of the tank through the action of the fluid motion through the circulation unit.

A general description of a method and apparatus for recovering the fuel value of crude oil sludge is described in related copending application, U.S. Ser. No. 08/553,900, which is incorporated herein in its entirety by reference.

Figure 1:
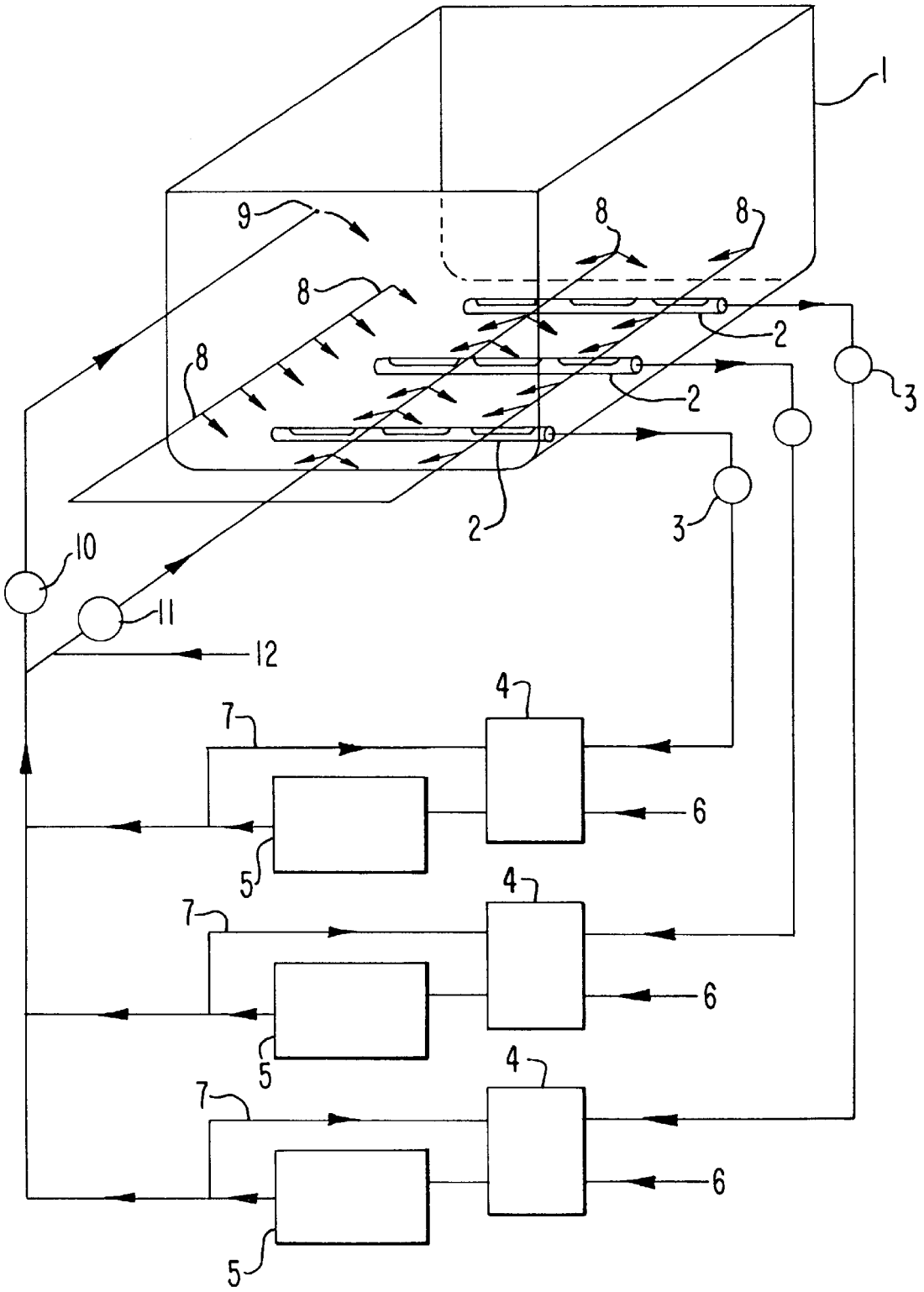
FIG. 1 is a schematic drawing showing the sludge treatment method of the present invention.
Figure 2:
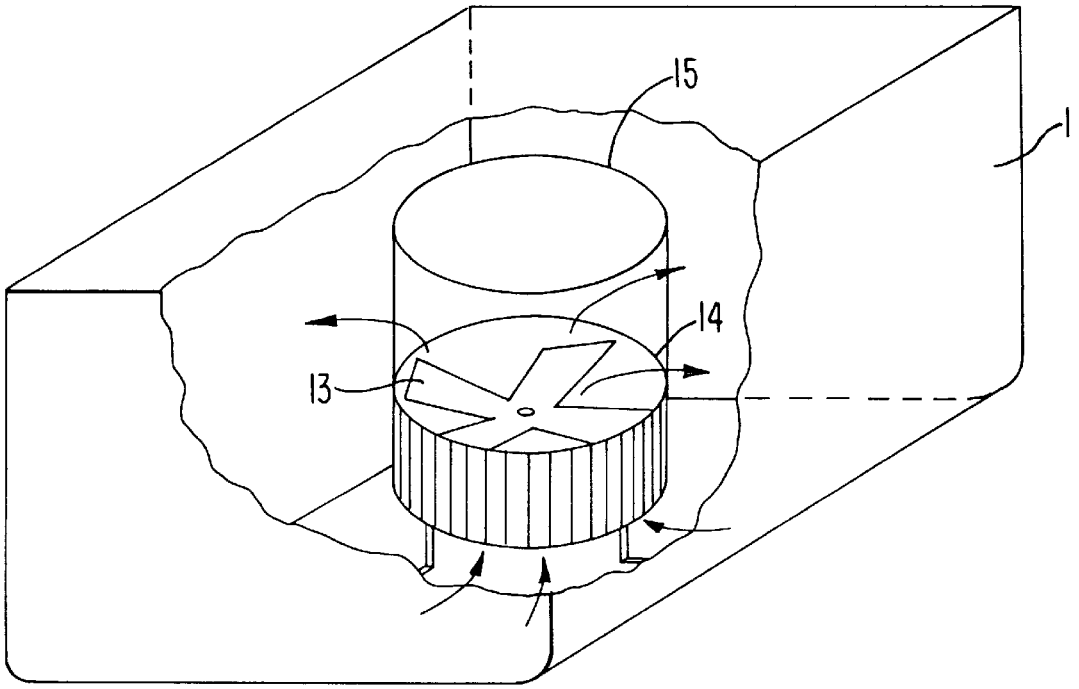
FIG. 2 is an illustration of a circulation unit in accordance with the present invention.
Figure 3:
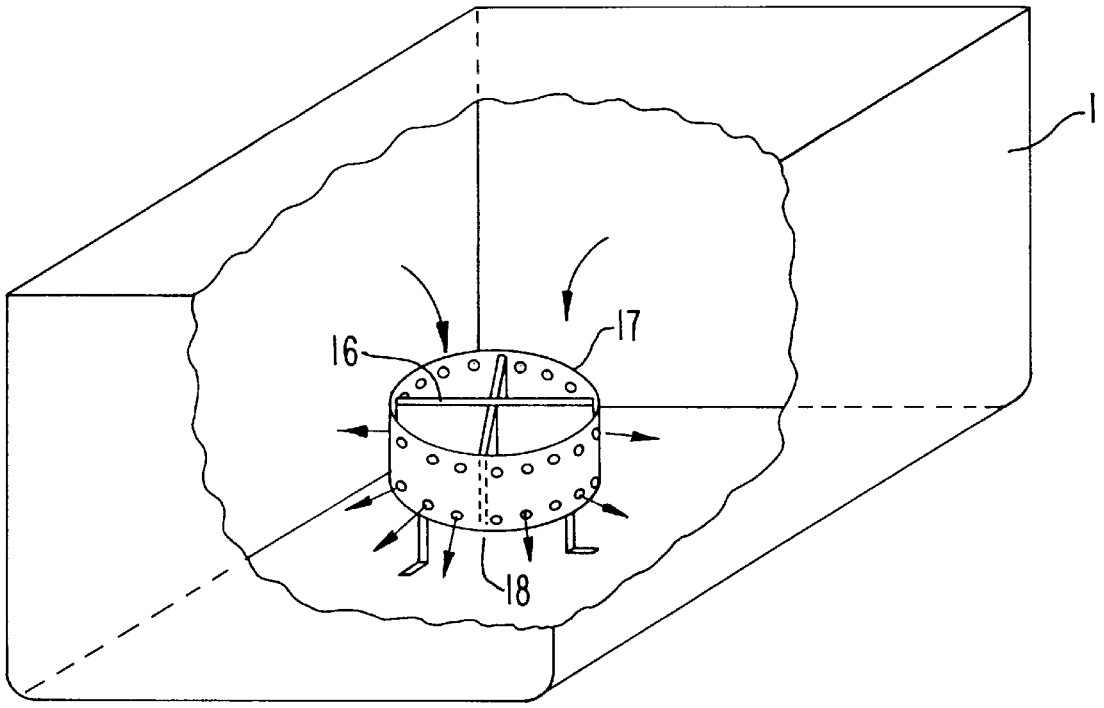
FIG. 3 is an illustration of another circulation unit in accordance with the present invention.

With reference to the Figures, FIG. 1 shows three auger pumps 2 at the bottom of the cargo tank discharging the sludge/crude oil mixture to the outside of the cargo tank. Additional pumps move the mixture to the holding tanks of the processors. The processors may recirculate some of their output to the holding tank. The output is pumped through injectors/nozzles back into the cargo tank to continue to loosen and circulate sludge and/or is pumped to a pipe that discharges the mixture directly into the cargo tank. FIG. 2 illustrates the circulation unit consisting of a propeller inside a tube. One or more of the propeller/tube units would be mounted in the cargo tanks to circulate and homogenize the crude oil and sludges in the fluid mixture. FIG. 3 illustrates the circulation unit consisting of an impeller inside a perforated tube. One or more of the impeller/stator units would be mounted in the cargo tanks to circulate and homogenize the crude oil and sludges in the fluid mixture.

The apparatus of the present invention generally includes three component units; a sludge recovery unit, a processing unit, and an optional circulation unit. The sludge recovery unit is a self contained apparatus that is mounted in the bottom of a cargo tank 1; the processing unit is located externally to the cargo tank in an area of the ship such as the pump room; and the circulation unit is mounted in the cargo tank.

The recovery unit may be of any configuration. An example of a suitable configuration is shown in FIG. 1, where a first unit described is a network of several auger pumps 2, each of which has an auger rotating inside a tube, the rotating motion moving the sludge down the length of the tube. Certain sections of the tube may be cut away so that the sludge can enter the tube from above. This preferred arrangement will permit the augers 2 to loosen solid globular sludge prior to being pumped inside the tube. The rotating augers act to break up the sludge as the sludge is moved along the length of the pipe. The auger pumps 2 can be powered by electric or hydraulic motors, the motors being attached to the augers or remotely mounted and connected to the augers by power transmission systems such as shafts, gears, or chains.

Additionally, the sludge can be pumped out of the cargo tank by centrifugal pumps that are designed for viscous material such as dredging pumps manufactured by H & H Pump and Dredge Company of Holden, La.

The recovery unit additionally is provided with at least one injector 8 which serves to inject a hydrocarbon cutter stock 12 or crude oil that is part of the cargo or processed sludge directly into the cargo tank in the vicinity of the auger pump tube opening. It is contemplated that the injectors 8 are positioned such that the pressurized fluid is injected to loosen the surrounding sludge from the bottom of the cargo tank so that it will more easily move to the auger pump 2 tube opening.

The extracted sludge mixture is moved through the pipe system by the auger pumps 2 in the tanks and an additional auger pump or pumps 3 and/or other types of positive displacement pump or pumps such a progressive cavity pumps. The extracted sludge may, and preferably is then fed to an intermediate reservoir or tank 4. The intermediate reservoir 4 will hold the liquid sludge prior to further treatment operations. The intermediate reservoir 4 may be provided with an inlet 6 for the addition of cutter stock and/or other additives. In addition, the intermediate reservoir 4 can be equipped with magnetic barriers and a sump to collect metal fragments and other objects that may have progressed through the oil collection and tanker systems to prevent their being passed through the processors 5. The inclusion of an intermediate reservoir 4 further serves to create a continuous source of material to the processor 5 by acting as a surge accumulator for material being pumped from the extraction pump 2. At times when the flow from the extraction pump 2 is low, processed material can be recirculated 7 into the intermediate reservoir tank 4 to ensure material being available to the input of the processor.

The extracted sludge is then transferred, either from the intermediate reservoir or directly from the cargo tank if no intermediate reservoir is included, to a processing unit 5 which includes a high shear mixer which is capable of blending, homogenizing, particle size reduction, and de-agglomeration. All material extracted from the cargo tank 1 by the extraction system 2 flows through the processor 5. The high shear mixer preferably includes a motor and an enclosed chamber with an inlet and an outlet. A suitable high shear mixer is described in detail in U.S. Ser. No. 08/553,900. Within the chamber, a work head is mounted on a spindle. The work head preferably is removable and several different interchangeable work heads preferably will be provided with the processing unit to allow for selective processing capabilities. The work head includes a stator about its outer periphery. The stator is provided with apertures or openings such that when the work head is subjected to high speed rotation, solid particles in the vicinity of the work head will be forced through the openings or apertures, thus reducing the particle size of the solids. The high speed rotation of the rotor blades within the work head exerts a powerful suction, drawing liquid and solid materials into the rotors. Centrifugal force then drives materials towards the periphery of the work head where they are subjected to a milling action. Hydraulic shear is then applied as the materials are forced, at high velocity, out through the perforations of the stator, then through the chamber outlet, exiting the mixing device.

The processing machine 5 may require a positive displacement pump provided upstream from the processor 5 to ensure most efficient processing volumes. For example, a progressing cavity type pump may be employed if necessary.

Downstream from the initial high shear mixer, additional holding tanks and processors may be provided to increase the breakdown of the solid globules to its smallest particle size as determined by the successively finer high shear mixing stators. The use of successively finer stators is dependent on the physical characteristics of the globules and how readily they break down.

In a preferred embodiment, at least one or as many as all of the individual components or tanks of the processing apparatus may be provided with flow measuring equipment which can monitor the quantity of extracted sludge, diluent, and blend stock at various stages of processing.

The flow of the sludge mixture through the system can be controlled either manually or automatically. If the control is automatic, it is contemplated that the system will be provided with a means to manually override the automatic control in the event the operator determines a change in the treatment parameters is warranted.

The system may also include one or more sifting screens and/or magnetic field generators upstream from the processing unit which will act to separate large or ferrous objects which would damage the processing components of the mixer.

In a typical embodiment, the processed sludge end product blend stock is added directly to the cargo tank 1, either to the tank at a high or intermediate level 9, or additionally or wholly at a lower level through injectors 8 placed at the bottom of the tank to induce internal circulation in the cargo tank and/or to the injectors that are part of the recovery system. Additional pumps 10 and 11 may be necessary to provide additional pumping pressure.

A circulation unit optionally can be utilized to increase the efficiency of homogenization of the crude oil with the tank sludge at such times that the cargo tank is substantially filled. The circulation unit can be of any design, but most expediently includes rotating propellers or impellers turning in a stator or a tube acting as a shroud.

In one embodiment, as shown in FIG. 2, the propeller 13 rotating in a tube 14 is shaped so that the outer edges of the propeller 13 follow closely the shape of the interior surface of the tube 14, with a uniform space between the edge of the propeller blades 13 and the inside of the tube 14. As the propeller 13 rotates at high speed, a powerful suction is created which draws liquid and solid material through the tube 14. Much of the liquid and solid material moves towards the outer edge of the propellers 13 through centrifugal force where they are subject to mechanical and hydraulic shear forces in the space between the ends of the propeller blades 13 and the inside of the tube 14. The propeller 13 can be rotated in a direction to draw the liquid and sludge up from the bottom. A diverting cone or plate 15 optionally can be placed above the propeller 13 at some distance below the surface of the liquid so that the circulation pattern remains an internal motion minimally incorporating air into the liquid. Optionally, the propeller 13 can be rotated in a direction to push the liquid downward to push settled sludge from the bottom of the tank 1.

In another embodiment shown in FIG. 3, an impeller 16 rotates in a stator 17, the stator 17 being a tube-like structure in which there is a uniform pattern of apertures or openings. Solid particles and globs of sludge in the vicinity of the impeller 16 will be forced through the openings or apertures, thereby reducing the particle size of the solids and breaking up the sludge. The high speed rotation of the impeller blades 16 within the stator 17 exerts a powerful suction, drawing liquid and solid materials into the impellers 16. Centrifugal force then drives materials towards the periphery of the stator 17 where they are subjected to milling action. Hydraulic shear is then applied as the materials are forced, at high velocity, out through the perforations of the stator 17. A plate 18 can be placed over the stator 17 causing the flow to be up through the bottom of the stator 17 and out through the sides of the stator 17, or, as shown in FIG. 3, the plate 18 can be placed under the stator 17 causing the flow to be downward through the top of the stator 17 and out through the sides of the stator 17.

The number of such circulation units and their placement in the cargo tanks 1 will be a function of the size and shape of the cargo tanks 1. The units could be individually mounted or be mounted in a sub-frame in the cargo tank 1. The rotating parts can be powered by hydraulic motors although other methods of providing the necessary mechanical rotation are also acceptable.

Additional advantages, features and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A system for extracting crude oil sludge from the bottom of a cargo tank, the system comprising:

at least one auger pump having an open top to collect and pump sludge;

at least one injector through which crude oil or other liquid is pumped to loosen sludge collected at the bottom of the cargo tank;

at least one conduit or pipe downstream from said pump for collecting and transporting sludge;

a comminution chamber downstream from said conduit or pipe including therein a means to reduce the size of sludge globules contained within the sludge mixture; and an outlet for removing a blend stock product.

2. A system as claimed in claim 1, wherein said auger pump includes an auger rotating inside a tube, said auger being capable of forcing said crude oil sludge through said tube by rotating action of said auger.

3. A system as claimed in claim 1, further comprising at least one centrifugal pump.

4. A method for converting crude oil tank bottoms to a liquid state using a system as claimed in claim 10 comprising:

subjecting crude oil sludge contained in the tanker cargo tank to a collection system to facilitate extracting the sludge mixture from the bottom of the tank;

comminuting the sludge mixture to reduce the size of sludge globules contained therein to produce a homogeneous mixture;

optionally adding crude oil from the cargo tank to increase the homogeneity of the mixture;

optionally adding an additional quantity of cutter stock and/or other selected additives to the sludge mixture, either before, during or after comminution, to form a blend stock.

5. A method as claimed in claim 4, wherein said liquid state produced has a product specification essentially identical to the crude oil in said tanker cargo tank.

6. A method as claimed in claim 4, further comprising a step of circulating the crude oil sludge within the cargo tank using circulation units.

7. A method as claimed in claim 6, wherein said circulating is conducted by one or more of shearing, mixing and/or homogenizing the sludge within the cargo tank using said circulation units.

8. A method as claimed in claim 6, wherein said circulation unit comprises a propeller inside a tube.

9. A method as claimed in claim 8, wherein said tube is perforated.

10. A method as claimed in claim 4, further comprising mixing sludge from the bottom of the cargo tank using at least one circulation unit.

11. A method as claimed in claim 4, wherein said collection system comprises at least one auger pump.

12. A method as claimed in claim 11, wherein said auger pump includes an auger rotating inside a tube, such that said crude oil sludge is forced through said tube by rotation of said auger.

13. An apparatus for extracting crude oil sludge from the bottom of a cargo tank comprising:

a sludge recovery unit comprising at least one auger pump having an open top to collect and pump sludge and at least one injector, said recovery unit being capable of being placed into said cargo tank; and a processing unit located external of said tank and in fluid communication with said sludge recovery unit, said processing unit comprising a comminution chamber including a means to reduce the size of sludge globules.

14. An apparatus as claimed in claim 13, further comprising an intermediate reservoir provided in fluid communication with said recovery unit and said processing unit.

15. An apparatus as claimed in claim 13, wherein said comminution chamber comprises a high speed mixer.

16. An apparatus as claimed in claim 15, wherein downstream from said high speed mixer, said processing unit includes at least one further processor.

17. An apparatus as claimed in claim 13, further comprising a circulation unit located within said tank, said circulation unit being capable of circulating sludge within said tank.

18. An apparatus as claimed in claim 17, wherein said circulation unit comprises a propeller inside a tube.

19. An apparatus as claimed in claim 18, wherein said tube is perforated.

20. An apparatus as claimed in claim 13, further comprising at least one sifting screen or magnetic field generator provided upstream from said processing unit.

* * * * *